US009257749B2

(12) United States Patent
Liou et al.

(10) Patent No.: US 9,257,749 B2
(45) Date of Patent: Feb. 9, 2016

(54) ANTENNA ASSEMBLY

(71) Applicant: Chiun Mai Communication Systems, Inc., New Taipei (TW)

(72) Inventors: Geng-Hong Liou, New Taipei (TW); Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 196 days.

(21) Appl. No.: 14/038,977

(22) Filed: Sep. 27, 2013

(65) Prior Publication Data

US 2014/0300524 A1 Oct. 9, 2014

(30) Foreign Application Priority Data

Apr. 9, 2013 (TW) ..... 102112525 A

(51) Int. Cl.
*H01Q 5/15* (2015.01)
*H01Q 1/24* (2006.01)
*H01Q 5/378* (2015.01)

(52) U.S. Cl.
CPC ..... *H01Q 5/15* (2015.01); *H01Q 1/243* (2013.01); *H01Q 5/378* (2015.01)

(58) Field of Classification Search
CPC ..... H01Q 5/15; H01Q 5/20; H01Q 5/30; H01Q 5/378; H01Q 1/243
USPC ..... 343/702, 700 MS
See application file for complete search history.

(56) References Cited

U.S. PATENT DOCUMENTS 7,358,906 B2 * 4/2008 Sato et al. ..... 343/702

FOREIGN PATENT DOCUMENTS

FI WO 2012/025787 * 3/2012 ..... H01Q 1/24

* cited by examiner

*Primary Examiner* — Hoang V Nguyen
(74) *Attorney, Agent, or Firm* — Novak Druce Connolly Bove + Quigg LLP

(57) ABSTRACT

An antenna assembly includes a feed end, a pair of ground ends, a first antenna, and a second antenna connected to the ground ends. The first antenna is connected to the feed end. The first antenna activates a high frequency band resonance mode. The second antenna is connected to the ground ends, and coupled with the first antenna to activate a low frequency band resonance mode. The feed end and the pair of ground ends are parallel to each other. The feed end and the pair of ground ends are coplanar to form a coplanar-waveguide feed structure.

18 Claims, 4 Drawing Sheets

ANTENNA ASSEMBLY

BACKGROUND

1. Technical Field

The disclosure generally relates to antenna assemblies and particularly to an antenna assembly having a wider bandwidth and a reduced size.

2. Description of Related Art

To communicate in multi-band communication systems, a bandwidth of an antenna of a wireless communication device such as a mobile phone should be wide enough to cover frequency bands of the multi-band communication systems. In addition, because of the miniaturization of the wireless communication device, space occupied by the antenna is compressed and limited. Therefore, it is necessary to design the antenna take up a smaller space.

Therefore, there is room for improvement within the art.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the disclosure.

DETAILED DESCRIPTION

Figure 1:
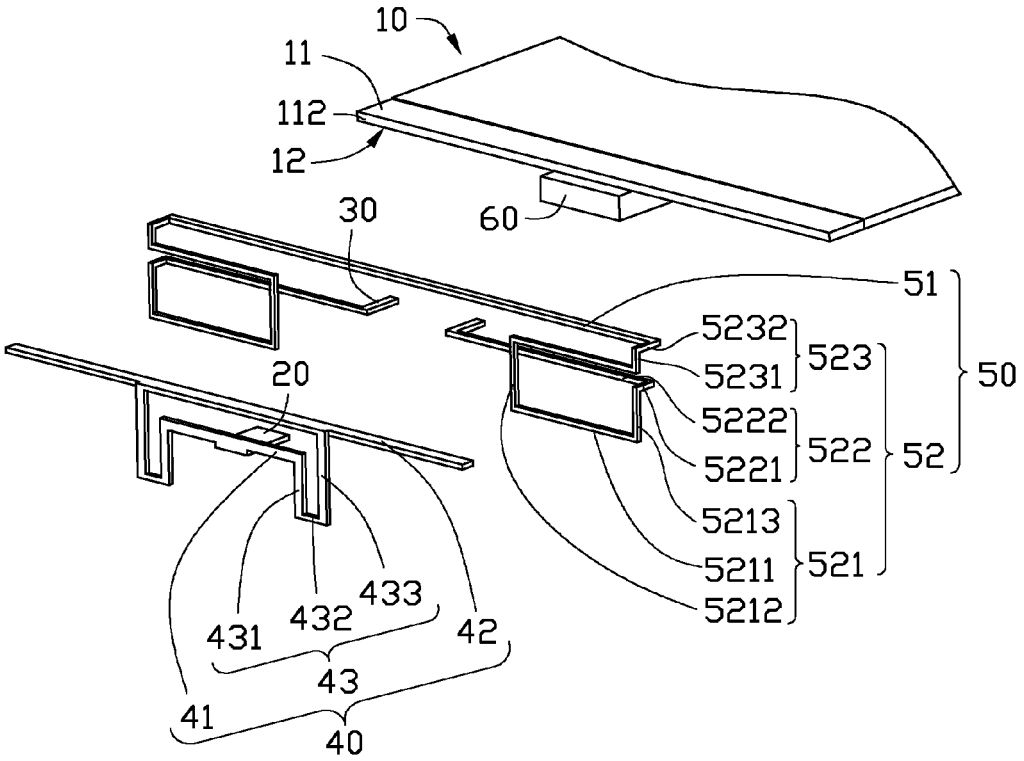
FIG. 1 is an exploded view of an antenna assembly, according to an exemplary embodiment of the disclosure.

FIG. 1 is a schematic view of an antenna assembly 100, according to an exemplary embodiment of the disclosure. The antenna assembly 100 includes a carrier 10, a feed end 20, and a pair of ground ends 30, a first antenna 40, a second antenna 50, and a metal member 60.

The carrier 10 may be a printed circuit board (PCB). The carrier 10 includes a first surface 11 and an opposite second surface 12. The first surface 11 includes an antenna mounting area 112. The antenna mounting area 112 is defined as an area where no conductive elements such as batteries, speakers, charge coupled devices (CCDs) are positioned to prevent interference from the conductive members to the antenna assembly 100.

The first antenna 40 includes a connecting arm 41, a first radiating arm 42, and a pair of combining portions 43 interconnecting the connecting arm 41 and the first radiating arm 42. The first radiating arm 42 and the connecting arm 41 are substantially strip-shaped and parallel to each other. A length of the connecting arm 41 is shorter than a length of the first radiating arm 42. Each combining portion 43 is substantially U-shaped and includes a first combining section 431, a second combining section 432, and a third combining section 433. The first combining section 431 is parallel to and spaced from the third combining section 433. The second combining section 432 is perpendicularly connected between the first combining section 431 and the third combining section 433. A length of the first combining section 431 is slightly shorter than a length of the third combining section 433. A distal end of the first combining section 431 opposite to the second combining section 432 is perpendicularly connected to one end of the connecting arm 41. A distal end of the third combining section 433 opposite to the second combining section 432 is perpendicularly connected to the first radiating arm 42. Thus, the connecting arm 41, the pair of combining portions 43, and a portion of the radiating arm 42 form a closed substantially U-shaped structure.

The feed end 20 is a substantially rectangular sheet perpendicularly connected to a middle portion of the connecting arm 41. The feed end 20 is positioned on a plane perpendicular to the first antenna 40.

The second antenna 50 includes a second radiating arm 51 and a pair of radiating units 52 and forms a hollow 3D open space. The first antenna 40 is positioned inside the 3D space of the second antenna 50. The second radiating arm 51 is substantially strip-shaped having a length slightly longer than that of the first radiating arm 42. Two ends of the second radiating arm 51 are respectively connected to one of the radiating units 52.

Each radiating units 52 includes a first radiating portion 521, a second radiating portion 522 connected to the first radiating portion 521, and a connecting portion 523 connected between the first radiating portion 521 and the second radiating arm 51.

The first radiating portion 521 is a substantially rectangular frame having an opening. The first radiating portion 521 includes two opposite first band sections 5211, a second band section 5212, and a third band section 5213 opposite to the second band section 5212. The second band section 5212 is perpendicularly connected between the first band sections 5211. A length of the third band section 5213 is slightly shorter than that of the second band section 5212. The third band section 5213 is perpendicularly connected to one of the first band sections 5211 and forms the opening with the other of the first band sections 5211.

The second radiating portion 522 is substantially L-shaped. The second radiating portion 522 includes a first radiating section 5221 and a second radiating section 5222 perpendicularly connected to the first radiating section 5221. An end of the first radiating section 5221 opposite to the second radiating section 5222 is perpendicularly connected to an end of the third band section 5213. An end of the second radiating section 5221 perpendicularly extends a distance along a direction opposite to the first radiating section 5221 to form one of the ground ends 30.

The connecting portion 523 is also substantially L-shaped. The connecting portion 523 includes a first connecting section 5231 and a second connecting section 5232 perpendicularly connected to the first connecting section 5231. The first connecting section 5231 perpendicularly extends from an end of one of the first band sections 5211 and is collinear with the third band section 5213. The second connecting section 5232 is perpendicularly connected to an end of the second radiating arm 51.

The metal member 60 is positioned on the second surface 12. In this embodiment, the metal member 60 is a housing of a universal serial bus (USB) connector.

The metal member 60 is configured to electronically connect to the ground ends 30 by a microstrip line, or a coaxial cable, etc. and provide a ground path for the antenna assembly 100 so that the antenna assembly 100 can obtain a better impedance matching.

Figure 2:
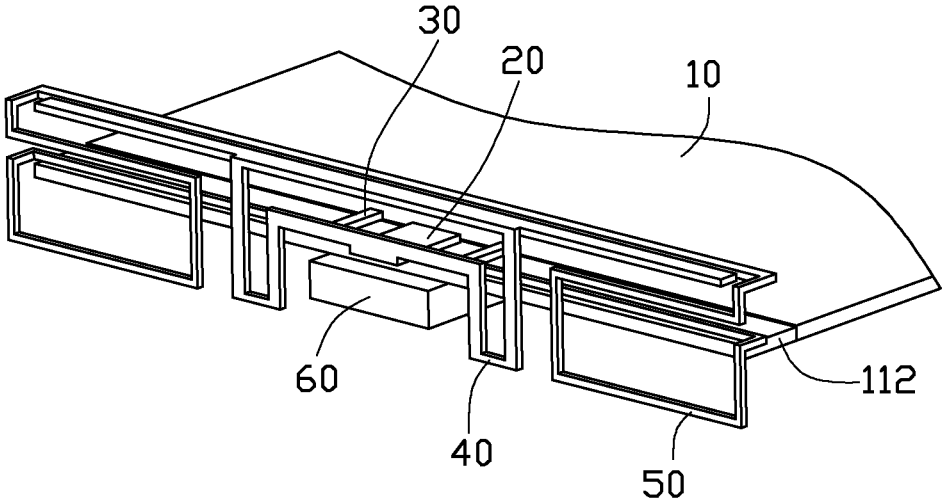
FIG. 2 is an assembled view of the antenna assembly of FIG. 1.
Figure 3:
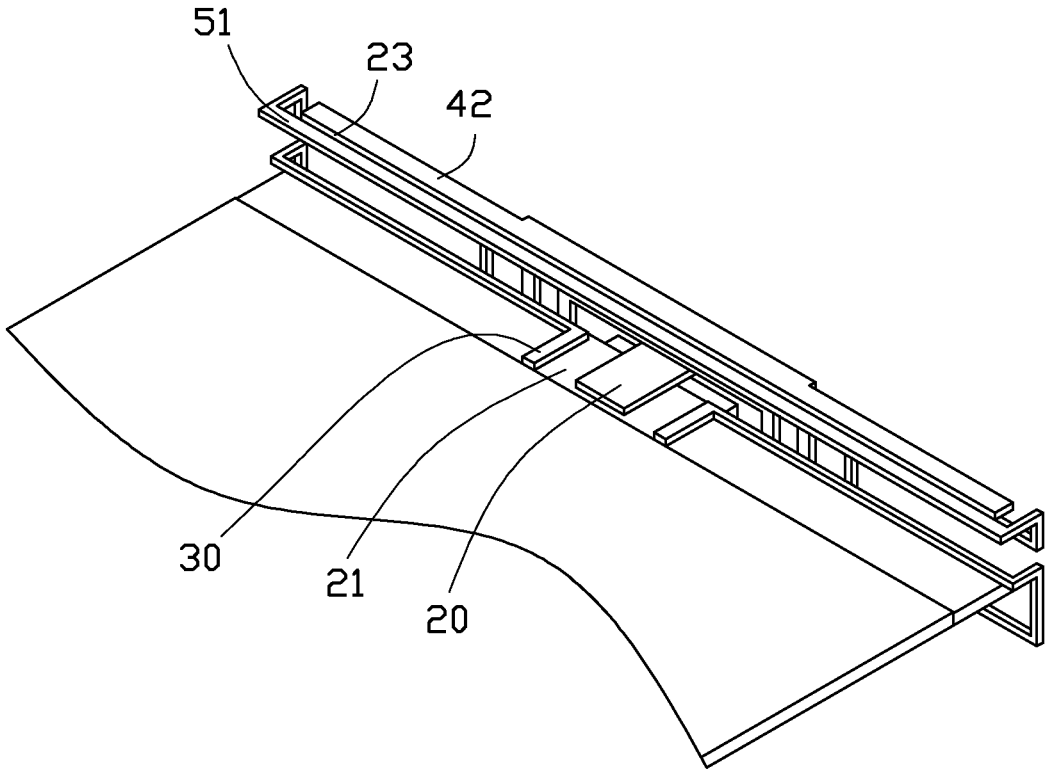
FIG. 3 is similar to FIG. 2, but shown from another aspect.

FIG. 2 shows that in assembly of the feed end 20, the pair of ground ends 30, and the second radiating portions 522 are positioned on the mounting area 12. The ground ends 30 are respectively positioned at two sides of the feed end 20 and parallel to each other. The ground ends 30 and the feed end 20 are coplanar and form a coplanar-waveguide feed structure to widen a bandwidth of the antenna assembly 100.

Figure 4:
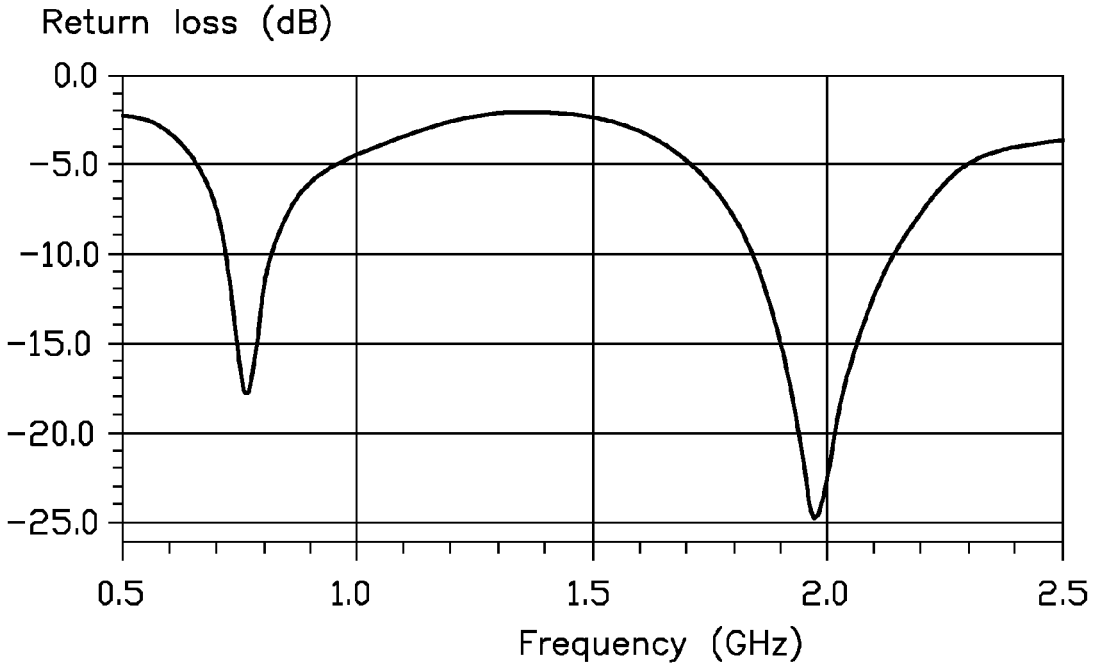
FIG. 4 is a diagram showing return loss measurements of the antenna assembly of FIG. 1.

In addition, each ground end 30 forms a first gap 21 with the feed end 202, and the first radiating arm 42 forms a second gap 23 with the second radiating arm 51. In use, because of the first gaps 21 and the second gap 23, the first antenna 40 is coupled with the second antenna 50. The first antenna 40 and the second antenna 50 cooperatively activate a low frequency band resonance mode so that the antenna assembly 100 can work at a first frequency band such as GSM frequency band. Meanwhile, the first antenna 40 independently activates a high frequency band resonance mode so that the antenna assembly 100 can works a second frequency band such as WCDMA frequency band. FIG. 4 shows that the antenna assembly 100 can satisfy design requirements at both GSM and WCDMA frequency bands.

Therefore, the antenna assembly 100 has a widen bandwidth by the coplanar-waveguide feed structure of the feed end 20 and the ground ends 30 and the resonance between the first antenna 40 and the second antenna 50. Moreover, the first antenna 40 is positioned between the two radiating units 52 of the second antenna 50 so that the antenna assembly 100 has a compressed and reduced volume.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An antenna assembly, comprising:

a feed end;

a pair of ground ends;

a first antenna connected to the feed end, the first antenna activating a high frequency band resonance mode; and a second antenna connected to the pair of ground ends, and coupled with the first antenna to activate a low frequency band resonance mode; wherein the feed end, the pair of ground ends are parallel to each other, the feed end and the pair of ground ends are coplanar to form a coplanar-waveguide feed structure;

wherein the first antenna comprises a connecting arm, a first radiating arm, and a pair of combining portions interconnecting the connecting arm and the first radiating arm to form a closed substantially U-shaped structure.

2. The antenna assembly of claim 1, wherein the first radiating arm and the connecting arm are substantially strip-shaped and parallel to each other, a length of the connecting arm is shorter than that of the first radiating arm; each combining portion is perpendicularly connected between the first radiating arm and the connecting arm; the feed end is perpendicularly connected to a middle portion of the connecting arm.

3. The antenna assembly of claim 2, wherein each combining portion is substantially U-shaped and comprises a first combining section, a second combining section, and a third combining section, the first combining section is parallel to and spaced from the third combining section, the second combining section is perpendicularly connected between the first combining section and the third combining section; a distal end of the first combining section opposite to the second combining section is perpendicularly connected to one end of the connecting arm, a distal end of the third combining section opposite to the second combining section is perpendicularly connected to the first radiating arm.

4. The antenna assembly of claim 1, wherein the second antenna comprises a second radiating arm and a pair of radiating units, the second radiating arm is substantially strip-shaped having a length slightly longer than that of the first radiating arm, two ends of the second radiating arm are respectively connected one of the radiating units.

5. The antenna assembly of claim 4, wherein the first radiating portion is a substantially rectangular frame having an opening; the first radiating portion comprises two opposite first band sections a second band section, and a third band section opposite to the second band section, the second band section is perpendicularly connected between the first band sections, a length of the third band section is slightly shorter than that of the second band section, the third band section is perpendicularly connected to one of the first band sections and forms the opening with the other of the first band sections.

6. The antenna assembly of claim 5, wherein the second radiating portion is substantially L-shaped, the second radiating portion comprises a first radiating section and a second radiating section perpendicularly connected to the first radiating section, an end of the first radiating section opposite to the second radiating section is perpendicularly connected to an end of the third band section, an end of the second radiating section perpendicularly extends a distance along a direction opposite to the first radiating section to form one of the ground ends.

7. The antenna assembly of claim 5, wherein the connecting portion is substantially L-shaped, the connecting portion comprises a first connecting section and a second connecting section perpendicularly connected to the first connecting section, the first connecting section perpendicularly extends from an end of one of the first band sections and is collinear with the third band section, the second connecting section is perpendicularly connected to an end of the second radiating arm.

8. The antenna assembly of claim 1, further comprising a metal member positioned on the second surface, wherein the metal member is configured to electronically connect to the ground ends and provide a ground path for the antenna assembly.

9. The antenna assembly of claim 1, further comprising a carrier, wherein the carrier comprises a first surface and an opposite to the second surface, the feed end and the ground ends are positioned on the first surface.

10. An antenna assembly, comprising:

a feed end;

a pair of ground ends;

a first antenna connected to the feed end, the first antenna activating a high frequency band resonance mode; and a second antenna connected to the pair of ground ends, and coupled with the first antenna to activate a low frequency band resonance mode; wherein the pair of ground ends are positioned at two opposite sides of the feed end and parallel to the feed end, the pair of ground ends are coplanar to form a coplanar-waveguide feed structure, the first antenna is positioned inside the second antenna;

wherein the first antenna comprises a connecting arm, a first radiating arm, and a pair of combining portions interconnecting the connecting arm and the first radiating arm to form a closed substantially U-shaped structure.

11. The antenna assembly of claim 10, wherein the first radiating arm and the connecting arm are substantially strip-shaped and parallel to each other, a length of the connecting arm is shorter than that of the first radiating arm; each combining portion is perpendicularly connected between the first radiating arm and the connecting arm; the feed end is perpendicularly connected to a middle portion of the connecting arm.

12. The antenna assembly of claim 11, wherein each combining portion is substantially U-shaped and comprises a first combining section, a second combining section, and a third combining section, the first combining section is parallel to and spaced from the third combining section, the second combining section is perpendicularly connected between the first combining section and the third combining section; a distal end of the first combining section opposite to the second combining section is perpendicularly connected to one end of the connecting arm, a distal end of the third combining section opposite to the second combining section is perpendicularly connected to the first radiating arm.

13. The antenna assembly of claim 10, wherein the second antenna comprises a second radiating arm and a pair of radiating units, the second radiating arm is substantially strip-shaped having a length slightly longer than that of the first radiating arm, two ends of the second radiating arm are respectively connected one of the radiating units.

14. The antenna assembly of claim 13, wherein the first radiating portion is a substantially rectangular frame having an opening; the first radiating portion comprises two opposite first band sections a second band section, and a third band section opposite to the second band section, the second band section is perpendicularly connected between the first band sections, a length of the third band section is slightly shorter than that of the second band section, the third band section is perpendicularly connected to one of the first band sections and forms the opening with the other of the first band sections.

15. The antenna assembly of claim 14, wherein the second radiating portion is substantially L-shaped, the second radiating portion comprises a first radiating section and a second radiating section perpendicularly connected to the first radiating section, an end of the first radiating section opposite to the second radiating section is perpendicularly connected to an end of the third band section, an end of the second radiating section perpendicularly extends a distance along a direction opposite to the first radiating section to form one of the ground end.

16. The antenna assembly of claim 14, wherein the connecting portion is substantially L-shaped, the connecting portion comprises a first connecting section and a second connecting section perpendicularly connected to the first connecting section, the first connecting section perpendicularly extends from an end of one of the first band sections and is collinear with the third band section, the second connecting section is perpendicularly connected to an end of the second radiating arm.

17. The antenna assembly of claim 10, further comprising a metal member positioned on the second surface, wherein the metal member is configured to electronically connect to the ground ends and provide a ground path for the antenna assembly.

18. The antenna assembly of claim 10, further comprising a carrier, wherein the carrier comprises a first surface and an opposite to the second surface, the feed end and the ground ends are positioned on the first surface.

* * * * *